United States Patent [19]

Frechette

[11] 4,060,162

[45] Nov. 29, 1977

[54] RIBBON LIFT GUIDE

[75] Inventor: Kenneth R. Frechette, Dallas, Tex.

[73] Assignee: Stamford, Xerox Corporation, Stamford, Conn.

[21] Appl. No.: 690,684

[22] Filed: May 27, 1976

[51] Int. Cl.[2] ..... B41J 1/24

[52] U.S. Cl. ..... 197/53; 197/170

[58] Field of Search ..... 197/18, 46, 53, 54, 197/151, 154, 157, 168, 170

[56] References Cited

U.S. PATENT DOCUMENTS

| | | | |
|---|---|---|---|
| 3,613,856 | 10/1971 | Reed | 197/54 |
| 3,946,852 | 3/1976 | Watson et al. | 197/53 |
| 3,954,163 | 5/1976 | Gabor | 197/53 |
| 3,964,595 | 6/1976 | Edstrom | 197/170 |
| 3,970,186 | 7/1976 | Sohl et al. | 197/54 |

*Primary Examiner*—Edgar S. Burr
*Assistant Examiner*—Paul T. Sewell

[57] ABSTRACT

A ribbon lift guide for a serial printer comprising a generally circularly shaped flexible disc member coupled to the hub of the print wheel element on the side of the print wheel containing the print surface of the character slug and positioned parallel to a plane formed by the spokes. The ribbon lift guide has a radius less than the distance from the center of the hub to the closest point on the print surface of the character slug. The guide is mounted coaxially with the print wheel to guide the ribbon during ribbon lift operation.

5 Claims, 5 Drawing Figures

RIBBON LIFT GUIDE

BACKGROUND OF THE INVENTION

This invention relates, in general, to ink ribbon-guide apparatus and more particularly to ink ribbon-guide apparatus employed in serial printers during the ribbon lift function of printer operation.

The Diablo Corporation a subsidiary of the present assignee, is marketing a serial printer under the tradename of Diablo Hytype I, which employs a movable carriage with a daisy type print wheel, print hammer and ribbon cartridge mounted thereon. A printer of this type is disclosed in a U.S. Pat. application filed Sept. 4, 1973, in the name of Andrew Gabor, Ser. No. 394,072, entitled "High-Speed Printer with Intermittent Print wheel and Carriage Movement", being a continuation of an application filed Feb. 25, 1972, Ser. No. 229,314, and now issued as U.S. Pat. No. 3,954,163 on May 4, 1976, the disclosure of which is incorporated by reference into this specification.

The Diablo Hytype I printer is enjoying commercial success as a serial printer in such applications as communication terminals, computer output devices, etc. However, in certain type applications, such as automatic text-editing typewriter applications in the office environment, additional features and capabilities are desired, e.g., higher print quality. In the text-editing or office-typing environment, the demands for high print quality cause the print wheel to be subjected to about ten times greater force due to about five times greater hammer energy compared to a Hytype I printer operating as a computer output terminal, for example.

A modified model of the Hytype I printer is employed as the printing mechanism of the commercially available Xerox 800 Electronic Typing System for automatic text-editing typewriter applications in the office environment. To provide the high print quality needed, the integrally molded thermoplastic print wheel of the Hytype I printer was replaced by a composite print wheel such as that disclosed in a copending U.S. Pat. application, filed May 6, 1976, in the name of Gordon Sohl et al., Ser. No. 683,977, being a continuation of an application filed Sept. 25, 1974, Ser. No. 509,193. In addition, a different print hammer assembly was incorporated therein which provided greater hammer energy. A card guide was added to the carriage to provide assistance in the operation of inserting and aligning paper in the automatic textediting typewriter. The Diablo Hytype I ribbon cartridge containing a fabric ribbon was replaced by a ribbon cartridge containing a matrix-type plastic ribbon from which a higher quality of printed material may be obtained.

In the environment provided by the modified printer, when the matrix-type plastic ribbon was impacted between the character slug of the print wheel and the paper, the plastic ribbon tended to curl or become cup shaped around a longitudinal centerline of the ribbon. The upper and lower edges of the plastic ribbon curled toward the print wheel. The spacings between the paper, ribbon and composite print wheel are extremely close because of the modification (addition of a card guide and the thicker character slugs of the new composite print wheel) to the printer, and on occasions the curled edge or edges of the plastic ribbon would make contact with the print wheel while the print wheel was rotating to the next print position. When this type of contact occurred, the plastic ribbon could, on occasions, be prevented from lifting or completely lifting to its print position from its lower rest position, resulting in the loss of that particular character or the cropping of the upper portions of the character or characters.

With these prior art problems in mind, it is a primary object of the present invention to design a simple and reliable means for guiding the ribbon during the ribbon lift function.

Another object of this invention is to provide an improved ribbon lift guide for reducing printing malfunctions during ribbon lift.

Yet, another object of the current invention is to provide a ribbon lift guide which rotates with the daisy wheel print element.

Other objects and advantages of the present invention will be evident from the specification and claims when read in conjunction with the accompanying drawing illustrative of the invention.

SUMMARY OF THE INVENTION

In accordance with the principles illustrative of this invention, the foregoing objects and others of the present invention are accomplished by a generally circularly shaped flexible disc member, which is coaxially coupled to the hub of the print wheel element and positioned on the side of the print wheel containing the print surface of the character slug. The ribbon lift guide disc has a radius less than the distance from the center of the hub to the closest point on the print surface of the character slug so that the disc does not interfer with the printing operation. The disc is positioned parallel to a plane formed by the spokes. An annular member formed of foam rubber is positioned between the disc and the spokes and coupled to the disc; said annular member being coaxial to the disc. The outer surface of the disc lies in a plane which contacts the outermost point on the character of the printing surface of the character slug. As the ribbon is raised from the down position to the up or print position, the disc guides the cupped ribbon past the printing surface of the character slug such that is does not contact said surface.

BRIEF DESCRIPTION OF THE DRAWING

Other advantages and features of the present invention may become more apparent from reading the following detailed descriotion in connection with the drawing forming a part thereof. in which.

DESCRIPTION OF THE PREFERRED EMBODIMENT

Figure 1:
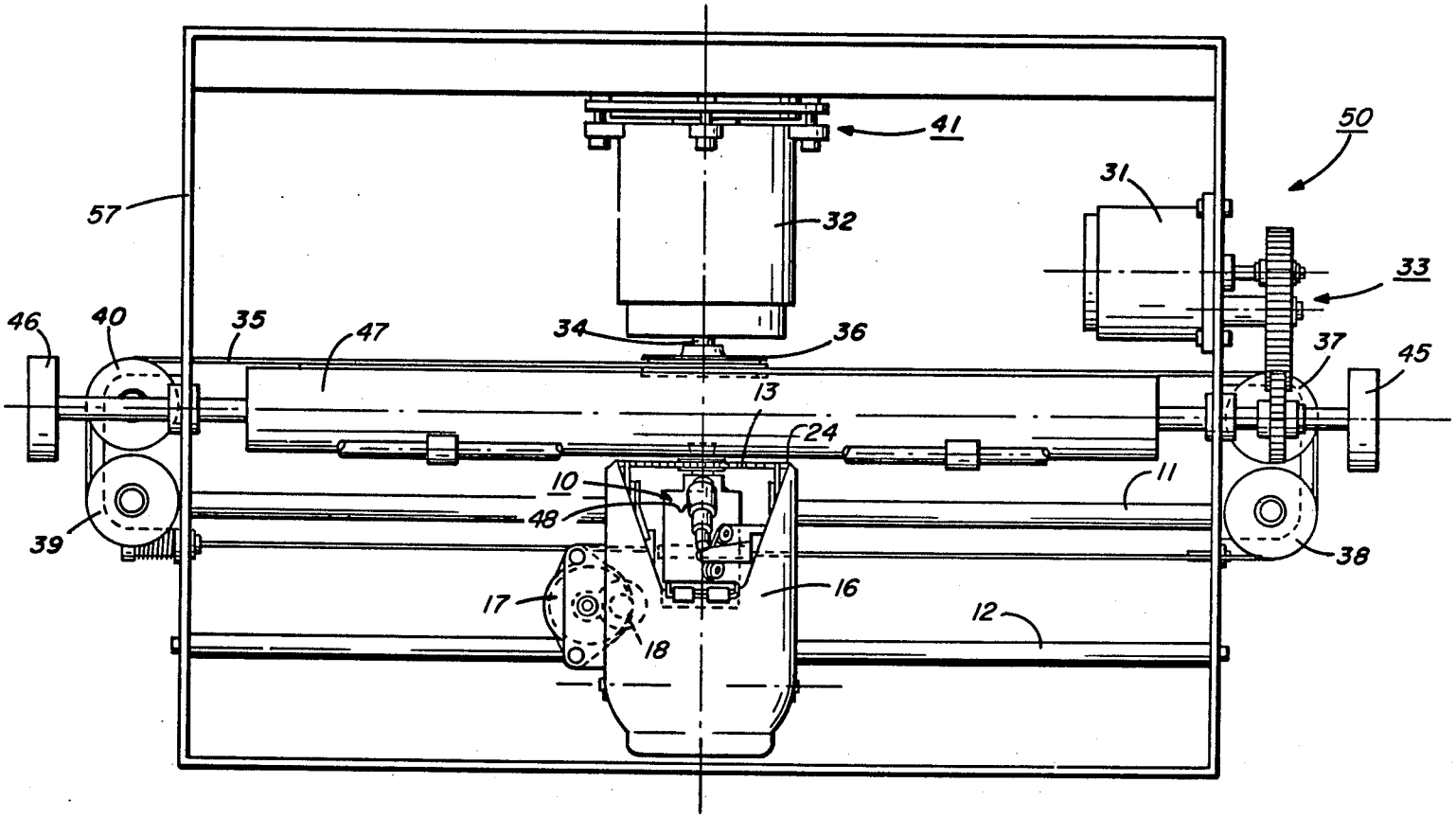
FIG. 1 is a top plan view of a printer embodying the present invention as viewed by the operator.

Referring now to the drawing and more particularly to FIG. 1, an overall view of the printer embodying the present invention is illustrated. Mounted on a base frame 57 is a platen 47 with knobs 45 and 46 for rolling the platen 47 and paper record medium (not shown) wrapped thereon. A carriage 10 is mounted for linear movement on the carriage mounting rails 11 and 12 bridged between opposed side walls of the base frame 57 of the printer 50. Carriage 10 includes a rotary print wheel 13 on which are a number of type elements or character slugs, a hammer-type impact printing mchanism 48 for striking a selected type element, a ribbon cartridge 16 having an inked ribbon 24 interposed between the paper on the platen 47 and the type element on the print wheel 13 located at the print position or station and a ribbon advance motor 17 as best shown in FIG. 2.

Furthermore, there are a stepping motor 31 and a servo motor 32 mounted on the base frame 57. The stepping motor 31 is coupled to the platen 47 by a gear train 33 so that the platen 47 is indexed when the motor 31 is activated to incrementally advance the paper through the printer 50. The servo motor 32, on the other hand, has one end of its drive shaft 34 coupled to the carriage 10 by a cable 35, which is trained around a series of pulleys 36–40, and the other end of its drive shaft 34 coupled to a shaft encoder 41. Thus, the carriage 10 is moved to translate the printing mechanism 48 lengthwise of the platen 47 when the servo motor 32 is actuated, while the encoder 41 supplies a signal which is representative of the actual position of the carriage 10 at any given time.

Figure 2:
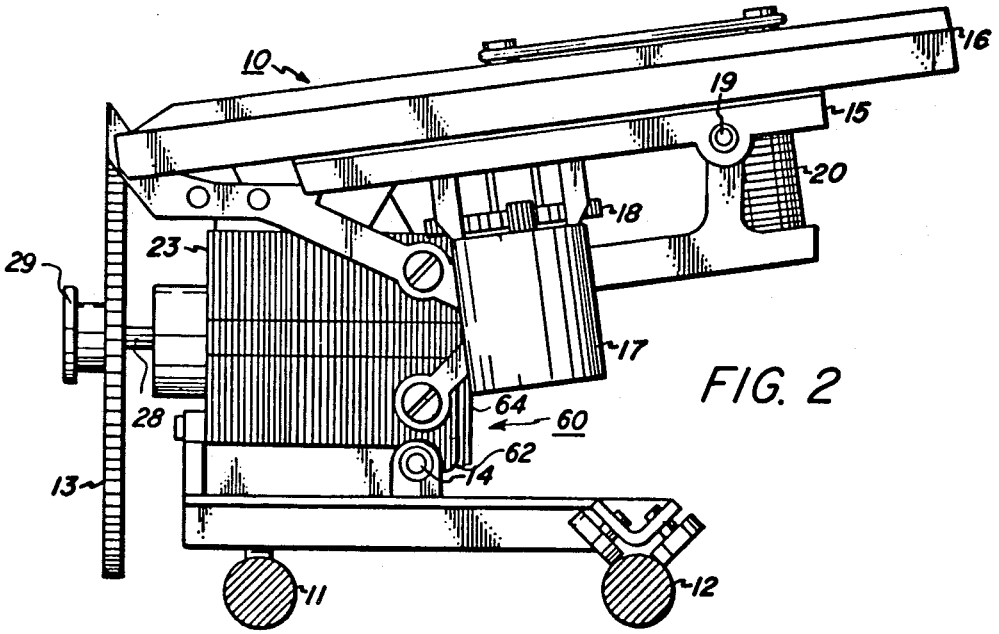
FIG. 2 is a side plan view of the carriage of the printer of FIG. 1.

With reference to FIGS. 1 and 2 and the printer carriage 10 mounted for linear movement on the mounting rails 11 and 12, as typing of the printed characters occurs, the carriage 10 stops each time a character is to be printed. Also, while the carriage 10 is moving from one location to the next location along rails 11 and 12 by moving the cable 35, the print wheel 13 is rotated such that the next character to be printed will be in position at the print position or station when the carriage 10 stops and the printing mechanism 48 is fired. As seen in FIG. 2, the upper portion of carriage 10 is pivotable clockwise about shaft 14 with respect to the lower portion of carriage 10. This pivoting motion is necessary in order to bring the print wheel 13 up into a position such that the print wheel may be exchanged for a different print wheel.

The ribbon cartridge mounting plate 15 provides the mounting structure for the ribbon cartridge 16, the ribbon advance motor 17 and the ribbon advance gearing 18. The ribbon cartridge mounting plate 15 is pivotable clockwise, in FIG. 2, about shaft 19. This pivoting motion is necessary to raise the ribbon from the down position, which is the position that allows the printed material to be viewed by the operator, to the up position at the print station when printing is to occur. The force to pivot the ribbon cartridge mounting plate 15 is a magnetic force supplied by electromagnet coils 20. When coils 20 are energized, that portion of the ribbon cartridge mounting plate 15 above coils 20 is drawn down toward the coils thereby raising that portion of the ribbon cartridge 16 which is nearest the print wheel 13 to the print position.

Still referring to FIGS. 1 and 2, carrriage 10 also includes a motor 23 having a shaft 28. Mounting on one end of the shaft is the rotary print wheel 13. Wheel 13 includes a central cap portion 29 constructed of rubber with a stiffening ring which allows the wheel 13 to be easily removed from the shaft 28 and, for example, replaced with another wheel with, for example, a different font of characters. The other end of shaft 28 has mounted thereon a transducer 60 which provides position signals related to the rotary positions of the shaft and, therefore, the print wheel 13. Transducer 60 includes a fixed disc 62 adjacent a disc 64 mounted for rotation with the shaft 28. Electrical interaction between these two discs 62 and 64 produced the position signals which are used in a servo system for controlling the print wheel 13. Consequently, when motor 23 is activated with the necessary signal, the print wheel 13 is rotated as necessary to bring any selected one of its character slugs 2 into alignment with the hammer printing mechanism 48 for printing out the selected character. Additionally, the transducer 60 supplies a continuously updated signal which is representative of the actual position of the print wheel 13.

Figure 3:
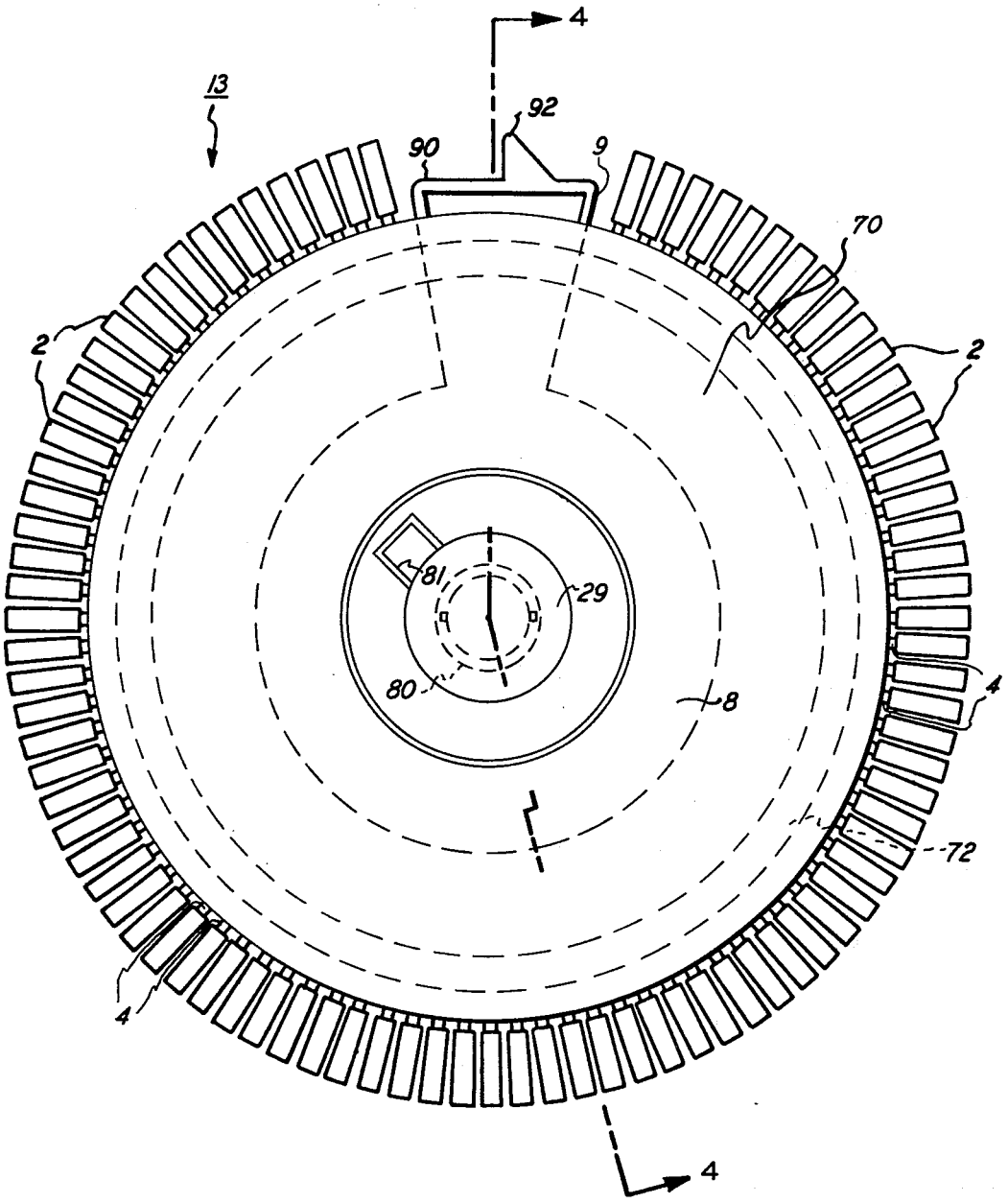
FIG. 3 is a plan view of a composite print wheel embodying the present invention.

With reference to FIG. 3, one embodiment of the present invention is shown in its mounted position relative to the print wheel. The print wheel 13 is a composite structure being made up of several components, the most prominent of which are the spokes or beams 4 with the character slugs 2 molded onto the ends thereof and the hub 8 riveted to the center of the wheel with its flag 9 extending outwardly amidst the spokes 4. Hole 80, in the center of hub 8, allows attachment of print wheel 13 to shaft 28 of print wheel motor 23. The alignment of print wheel 13 to shaft 28 is provided by the key-way or notch 81. Another component includes a central cap portion 29 for handling the print wheel 13 which resides at the core of the print wheel on top of the hub 8.

The flag 9 is integral with hub 8, being fabricated with the hub as a unit in an injection molding process. The flag 9 is a truncated pie-shaped element whose width increases with radii unlike spokes 4 which have a fixed width over their length. The outer end of the flag 9 including a straight edge 90, which underlines the line of characters being printed. When the ribbon 24 is in the down position, which allows the operator to view the printed material, the top edge of the ribbon is approximately even with the straight edge 90. At the very end of the flag 9 is the pointer 92, which is a vertical reference mark to help the operator to visually align the eye to the printing position.

The ribbon lift guide comprises a generally circularly shaped flexible disc 70 coupled to the hub 8 of the print wheel 13 and is positioned on the side of the print wheel containing the print surface of the character slug 2. Disc 70 lies in a plane parallel to a plane formed by the spokes 4. In the particular embodiment disclosed, disc 70 has an outside radius of about 1.25 inches and an inside radius of about 0.5 inches. An annular or ring member 72 is coupled to the disc 70 and positioned between the disc 70 and spokes 4 of the print wheel 13. Ring 72 stabilizes the position of disc 70 during the rotation of print wheel 13 and during the printing operation. Ring 72 also acts as a damper for spokes 4 after the printing operation of the particular character slug 2 attached to the spoke 4. In the particular embodiment disclosed, ring member 72 was formed from foam plastic (Roger RFF-263) and also from 4 LB./CU.FT. Ester-type non-reticulated polyester foam with 60 pores/inch (Scott 4LB. custom foam). The outside radius of ring 72 was about 1.125 inches and the inside radius was about 1.00 inches.

Figure 4:
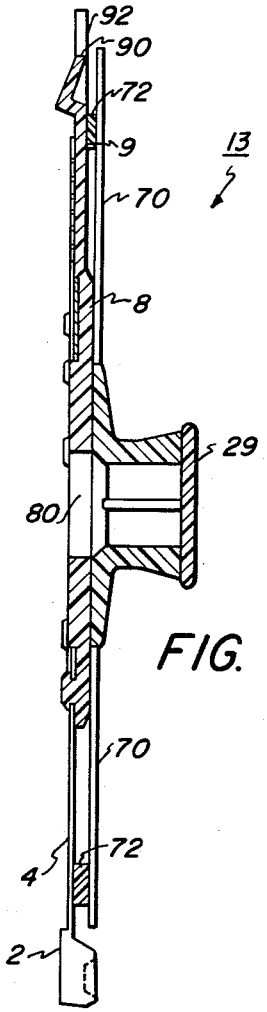
FIG. 4 is a sectional elevation view of the composite print wheel in FIG. 3 taken through lines 4—4.

The space relationship between disc 70 and print wheel 13 is shown more clearly in FIG. 4. Disc 70 lies in a plane parallel to a plane formed by spokes 4 and extends outward from the hub 8 to a point near the closest point on the print surface of the character slug 2. Disc 70 does not contact character slugs 2. In the embodiment shown, disc 70 was formed from the thermoplastic CELLULOID (trademark of Celanese Corporation of America) with a thickness of 5 mils. By forming the outer periphery of disc 70 to fall near the character slug print surface, when the ribbon is raised up to the print position, disc 70 guides the ribbon past the print surface of character slug 2 so that the ribbon does not contact the slug.

As shown in FIG. 4, ring 72 is coupled to disc 70 and is positioned between disc 70 and spokes 4, thereby maintaining the correct distance between the outer surface of disc 70, spokes 4 and character slug 2. In the embodiment shown, the thickness of ring 72 is approximately 0.05 inches.

Figure 5:
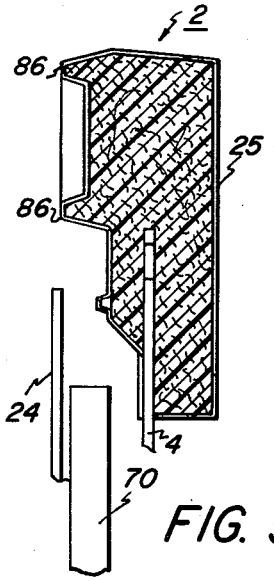
FIG. 5 is an enlarged side sectional view illustrating the relative position between a typical character slug and the invention.

FIG. 5 is an enlarged side sectional view illustrating the relative position between a typical character slug 2, the disc 70 and the ribbon 24. The ribbon 24 is shown in the down or non-print position. As the ribbon 24 is raised up to the print position, disc 70 will prevent the ribbon 24 from catching on the print surface 86 of the character slug 2.

It will be appreciated that there has been shown an illustrative arrangement for use in a print wheel impact printer to provide for guiding the ribbon during the ribbon lift operation that fully satisfies the objects, aims and advantages set forth above. While the principles of the invention have been made clear in the illustrative embodiment, it is apparent that alternatives, modifications and variations will be evident to those skilled in the art. Accordingly, it is intended to embrace all alternatives, modifications and variations as fall within the spirit and broad scope of the appended claims.

What is claimed is:

1. In a printer having a platen for supporting a record medium, a laterally movable carrier for traversing a print line, a printing mechanism supported on said carrier for printing characters on said record medium, wherein said printing mechanism includes a print hammer, rotatable daisy wheel print element including a hub, a plurality of spokes extending radially outward from said hub and each spoke terminating in a character slug with a print surface and an impact surface, a ribbon supply means, a ribbon feed means for feeding an ink ribbon past said print element and a ribbon lift means for positioning said ribbon between a first position and then a second position for printing; an improved ribbon lift guide comprising:

a substantially circularly shaped flexible disc member coupled to the hub of the print wheel element on the side of the print wheel containing the print surface of the character slug and positioned in a first plane formed by the print surfaces of said character slugs, said first plane being parallel to and a predetermined distance from a second plane formed by said spokes, said disc having a radius of a predetermined value less than the distance from the center of the hub to the closest point on the print surface of the character slug, the distance between the outer periphery of the disc and the closest point on the print surface being less than the height of the ribbon, said disc being coaxial with the print wheel to guide the ribbon to a print position with respect to the print surfaces during ribbon lift operation; and an annular member positioned between the disc and the spokes and coupled to the disc to maintain the disc in operable relationship with the print surfaces, said member being coaxial with the disc.

2. The improvement of claim 1 wherein said annular member has an outer radius less than the radius to the closest point on the print surface of the character slug and has an inner radius greater than the radius of the hub.

3. The improvement of claim 1 wherein said annular member includes foam rubber.

4. The improvement of claim 1 wherein said disc member includes thermoplastic.

5. The improvement of claim 1 wherein said disc member is on the order of 5 mils in thickness.

* * * * *